US006044811A

United States Patent [19]

Kouchi et al.

[11] Patent Number: 6,044,811

[45] Date of Patent: Apr. 4, 2000

[54] AIR GUIDE CASING FOR AIR-COOLED ENGINE

[75] Inventors: Hiroyoshi Kouchi; Kazuyuki Kobayashi; Shogo Nakamura, all of Nagoya, Japan

[73] Assignee: Mitsubishi Heavy Industries, Ltd., Tokyo, Japan

[21] Appl. No.: 09/171,178

[22] PCT Filed: Feb. 13, 1998

[86] PCT No.: PCT/JP98/00579

§ 371 Date: Oct. 14, 1998

§ 102(e) Date: Oct. 14, 1998

[87] PCT Pub. No.: WO98/36162

PCT Pub. Date: Aug. 20, 1998

[30] Foreign Application Priority Data

Feb. 14, 1997 [JP] Japan ..... 9-047343

[51] Int. Cl.[7] ..... F01P 1/02

[52] U.S. Cl. ..... 123/41.7; 123/41.56; 123/41.65; 123/41.79

[58] Field of Search ..... 123/41.7, 41.62, 123/41.65, 41.69, 41.79, 41.56

[56] References Cited

U.S. PATENT DOCUMENTS

| | | | |
|---|---|---|---|
| Re. 33,978 | 6/1992 | Shirai | 123/41.7 |
| 2,219,516 | 10/1940 | Doman et al. | 123/41.7 |
| 2,699,764 | 1/1955 | Kiekhaefer | 123/41.7 |
| 2,740,390 | 4/1956 | Irgens | 123/41.7 |
| 3,530,840 | 9/1970 | Freyn | 123/41.7 |
| 3,994,067 | 11/1976 | Hazzard et al. | 30/383 |
| 4,672,922 | 6/1987 | Shirai | 123/41.66 |
| 5,233,946 | 8/1993 | Yamami | 123/41.63 |
| 5,317,997 | 6/1994 | Tomitaku | 123/41.7 |

FOREIGN PATENT DOCUMENTS

| | | |
|---|---|---|
| 60-23210 | 2/1985 | Japan . |
| 61-183430 | 11/1986 | Japan . |
| 2-3016 | 1/1990 | Japan . |
| 08338242 | 12/1996 | Japan . |

*Primary Examiner*—Tony M. Argenbright
*Assistant Examiner*—Brian J. Hairston
*Attorney, Agent, or Firm*—Foley & Lardner

[57] ABSTRACT

There is provided an air guide casing for an air-cooled engine, characterized in that in an air-cooled engine, the air guide casing comprises an air guide member (11) (12) consisting of a synthetic resin molded product, which is fixed so as to connect with an inside air guide casing (30), an outside air guide casing (6) provided on the outside of the air guide member (11) (12) so as to cover the air guide member, and positioning means (13) for positioning the air guide member (11) (12) with respect to a cylinder block (2); the air guide member (11) (12) is positioned with respect to the cylinder block (2) through the positioning means (13); and the air guide member is fixed by holding and pressing at least one place of the air guide member (11) (12) between the tightening portion of the outside air guide casing (6) and the cylinder block (2). By minimizing the use of a sheet metal member, vibrations of the air guide casing including a fan cover is reduced, and noises produced by the resonance with engine vibration or other causes are prevented. Also, the number of bolts used and the working man-hour for welding etc. are decreased to achieve a cost reduction, and moreover the weight is reduced. Further, a gap developing at the attaching portion where the air guide casing is attached to a cylinder block is eliminated, by which the leakage of cooling air and the amplification of vibrations due to the gap are prevented.

9 Claims, 7 Drawing Sheets

AIR GUIDE CASING FOR AIR-COOLED ENGINE

FIELD OF THE INVENTION

The present invention relates to an air guide casing (air conduction casing) construction for an air-cooled engine such as a general-purpose air-cooled single-cylinder engine.

BACKGROUND ART

An air-cooled engine, such as a general-purpose air-cooled single-cylinder engine, having a cylinder block made of aluminum alloy die casting is provided with an air guide casing for guiding cooling air from cooling fins to a high-temperature section of the cylinder block, etc.

One example of such an air-cooled engine in which an air guide casing is attached to a cylinder block, which has been disclosed in Japanese Utility Model Provisional Publication No. 60-23210 (No. 23210/1985), is shown in FIGS. 10 and 11.

FIG. 10 is a partially sectional view in which a fan cover portion of an engine is cut away, and FIG. 11 is a sectional view taken along the line E—E of FIG. 10. In FIG. 10, reference numeral 01 denotes an air-cooled single-cylinder engine having an inclined cylinder, and 02 denotes a cylinder block for the engine 01. The cylinder block 02 is a product made of aluminum alloy die casting, in which a cylinder barrel 03 having a cooling fan, a crankcase 02*a*, and the like are integrated.

A cooling fan 09 rotationally driven by a crankshaft (not shown) is provided at the side of the cylinder barrel 03, and the cooling fan 09, the cylinder barrel 03, and a cylinder head 06 are covered by a fan cover 010 from the side.

The fan cover 010 is the integration of a housing 011 for covering the cooling fan 09 and an air guide cover 013 for covering the cylinder barrel 03 and the cylinder head 06. An air intake (not shown) is open at the center of the housing 011. Also, a shroud 015 made of sheet metal is joined in a contacting manner by welding etc. along the lower side portion of the air guide cover 013 from the housing 011. Thereupon, there is no gap between the shroud 015 and the fan cover 010, both elements being integrated.

The shroud 015 continuously forms an arcuate edge 016 of the cylinder block 02, which is formed so as to extend to the crankcase 02*a* side, and a straight edge 017, which is formed so as to extend throughout the cylinder barrel 03 side and the cylinder head 06 side.

The cylinder block 02 has a wall-shaped rib 05 over the range from the crankcase 02*a* to the cylinder head 06. The shroud 015 and the fan cover 010 are in contact with the rib 05, whereby a cooling air path on the upstream side of cylinder is formed.

In the conventional engine 01 configured as described above, the cooling air produced by the cooling fan 09 is concentrated and guided to the high-temperature cylinder barrel 03 and cylinder head 06 by the fan cover 010, by which the cooling air is allowed to flow in layers to increase the cooling performance.

However, the engine having the air guide casing construction relating to the prior art, as shown in FIGS. 10 and 11, has the following problems to be solved.

(1) Since the shroud 015 is made of sheet metal, noise occurs easily due to resonance with engine vibration.

Also, since the edge of sheet metal is in contact with the cylinder block 02 at the portion of the shroud 015, a gap is liable to develop at this contact portion, whereby the leakage of cooling air and vibrations occur easily.

(2) Since the fan cover 010, which is formed by integrating the shroud 015 with the housing 011 by welding, is fastened to the cylinder block 02 with bolts, the number of bolts used is large, so that the assembly man-hour as well as the working cost is increased.

(3) Since the whole of the fan cover 010 including the shroud 015 is made of sheet metal, the weight is high.

The present invention was made in view of the above situation. Accordingly, a first object of the present invention is to provide an air guide casing for an air-cooled engine, which is configured so that vibrations of the air guide casing including a fan cover can be reduced by minimizing the use of members made of sheet metal, and noises produced by the resonance with engine vibration or other causes can be prevented.

A second object of the present invention is to provide an air guide casing for an air-cooled engine, in which the number of bolts used and the working man-hour for welding etc. can be decreased to achieve a cost reduction, and moreover the weight can be decreased.

A third object of the present invention is to provide an air guide casing for an air-cooled engine, which is configured so that a gap developing at the attaching portion where the air guide casing is attached to a cylinder block can be eliminated, by which the leakage of cooling air and the amplification of vibrations due to the gap can be prevented.

SUMMARY OF THE INVENTION

To achieve the above objects, a first embodiment provides an air guide casing for an air-cooled engine, characterized in that, in an air-cooled engine having a cylinder block in which a cylinder barrel, crankcase, and inside air guide casing are formed integrally, the air guide casing comprises an air guide member consisting of a synthetic resin molded product, which is fixed so as to connect with the inside air guide casing, an outside air guide casing provided on the outside of the air guide member so as to cover the air guide member, and positioning means for positioning the air guide member with respect to the cylinder block, the air guide member is positioned with respect to the cylinder block through the positioning means, and the air guide member is fixed by holding and pressing at least one place of the air guide member between the tightening portion of the outside air guide casing and the cylinder block.

Also, a second embodiment relates to an attaching construction of the air guide member and outside air guide casing to the cylinder block, and provides an air guide casing for an air-cooled engine defined in the first embodiment, wherein the cylinder block is formed with a recess depressed so that the portion to which the air guide member is attached is shallower by a press allowance than the thickness of the attaching portion of the air guide member, and the air guide member is formed so that the edge face which is in contact with the outside air guide casing is flush with the attaching face to the cylinder block.

According to the first and second embodiments, the air guide member consisting of a synthetic resin molded product is positioned at the air guide housing attaching position of the cylinder block through positioning means such as a pin, the attaching end of the outside casing is lapped over the outside of the attaching portion of the air guide member, the attaching portion of the air guide member is fitted into the attaching recess formed in the cylinder block, the attaching portion of the air guide member is held between the outside casing and the recess of the cylinder block, and three elements are tightened together.

When the tightening operation is performed, since the tightening is performed in such a state that the press allowance is provided by making the thickness of the attaching portion of the air guide member slightly larger than the depth of the recess of the cylinder block, the air guide member is surely fixed to the cylinder block.

Since the air guide member connects the outside air guide casing to the cylinder block, the air guide member has a function of complementing the shroud portion of the inside air guide casing. Also, since the air guide member consists of a molded product made of synthetic resin, the weight is reduced as compared with the conventional shroud made of sheet metal, and a high vibration damping capacity is achieved, by which the occurrence of noise is prevented.

Also, since the air guide member performing the function of a shroud is fixed by being held and pressed between the outside air guide casing and the cylinder block as described above, bolts for fixing the air guide member are unnecessary, so that the number of parts is decreased, and the assembly man-hour is reduced.

Further, since the air guide member consisting of a synthetic resin molded product has a higher degree of freedom in shape and higher elasticity than the sheet metal member, by fixing the air guide member between the outside air guide casing and the cylinder block with the press allowance being provided as described above, the gap at the connecting portion is eliminated completely. Thereby, the leakage of cooling air is decreased, and the cooling efficiency is increased.

In addition to the first and second embodiments, it is preferable that the air guide member be configured so as to be provided with a reinforcing rib on the face thereof on the side of the cylinder block.

Thus configured, the presence of the reinforcing rib can assure a strength sufficient to perform the function of a shroud even if the air guide member consists of a synthetic resin molded product which has a lower strength than the sheet metal member.

DETAILED DESCRIPTION

A preferred embodiment of the present invention will be described in detail below with reference to the accompanying drawings.

Unless otherwise noted, for the size, material, shape, relative arrangement, and the like of the components described in this embodiment, the scope of the present invention is not limited to those, and they are merely examples for explanation.

Figure 1:
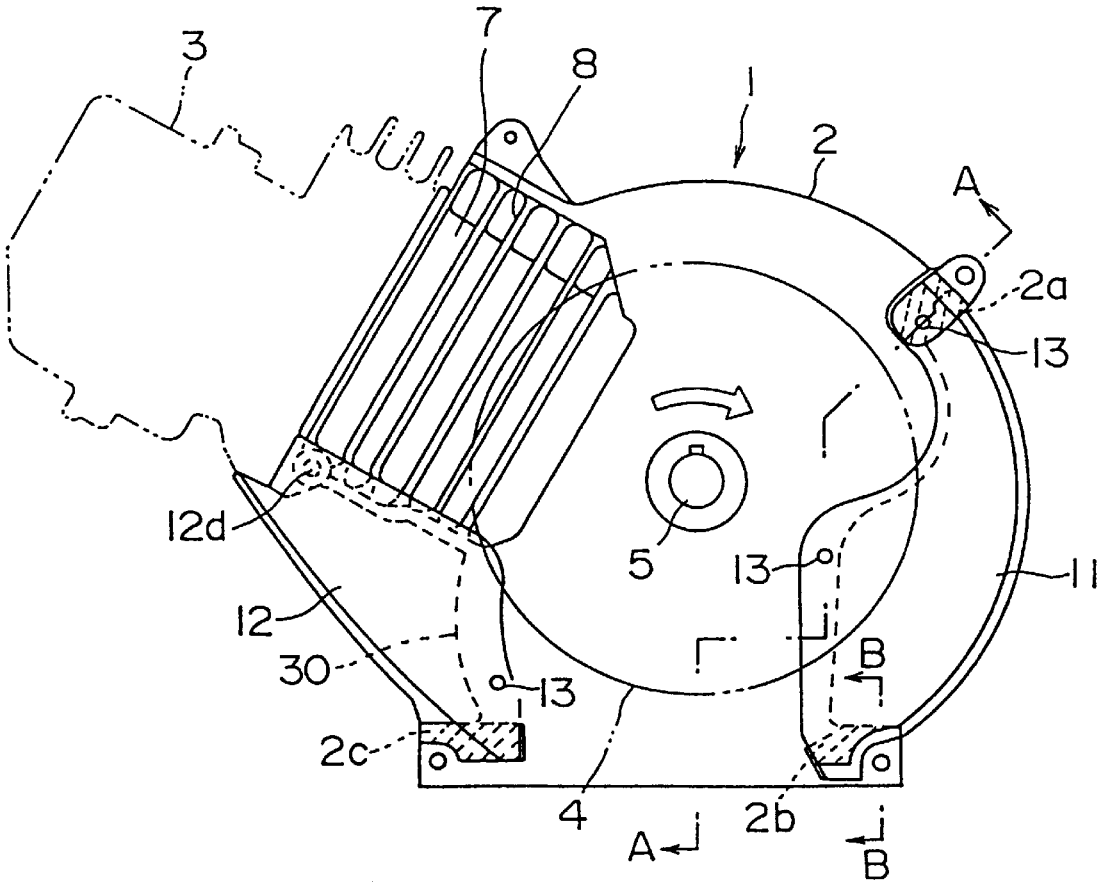
FIG. 1 is a front view showing a state in which an outside air guide casing for a general-purpose air-cooled single-cylinder engine in accordance with an embodiment of the present invention is removed.
Figure 2:
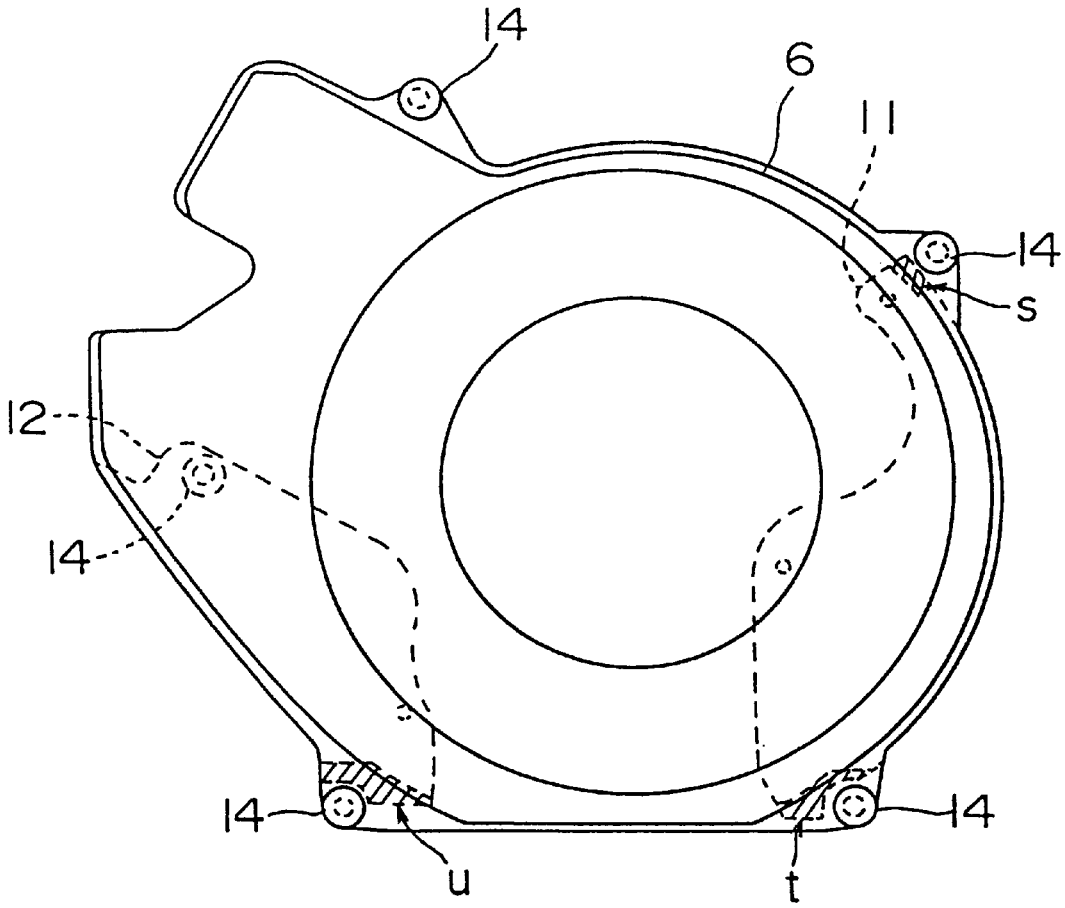
FIG. 2 is a front view showing a state in which an outside air guide casing in the aforesaid embodiment is installed.
Figure 3:
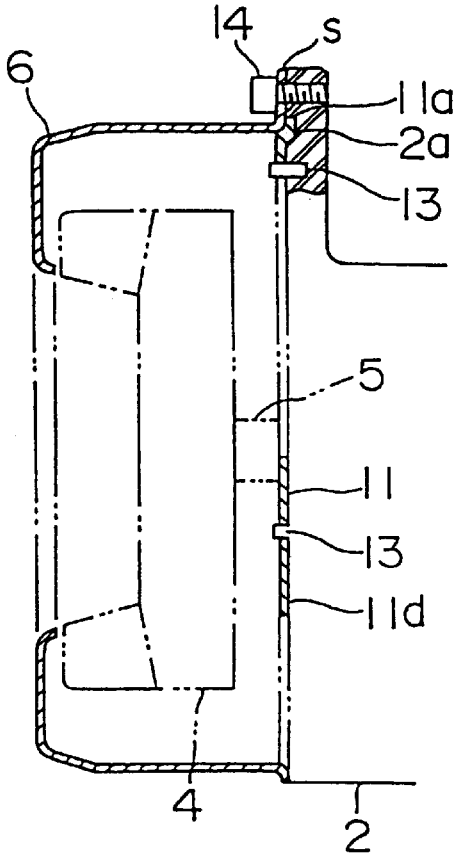
FIG. 3 is a sectional view taken along the line A—A of FIG. 1.
Figure 4:
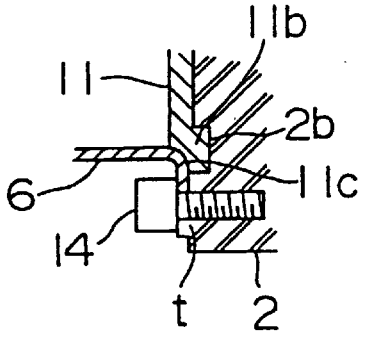
FIG. 4 is a sectional view taken along the line B—B of FIG. 1.
Figure 5:
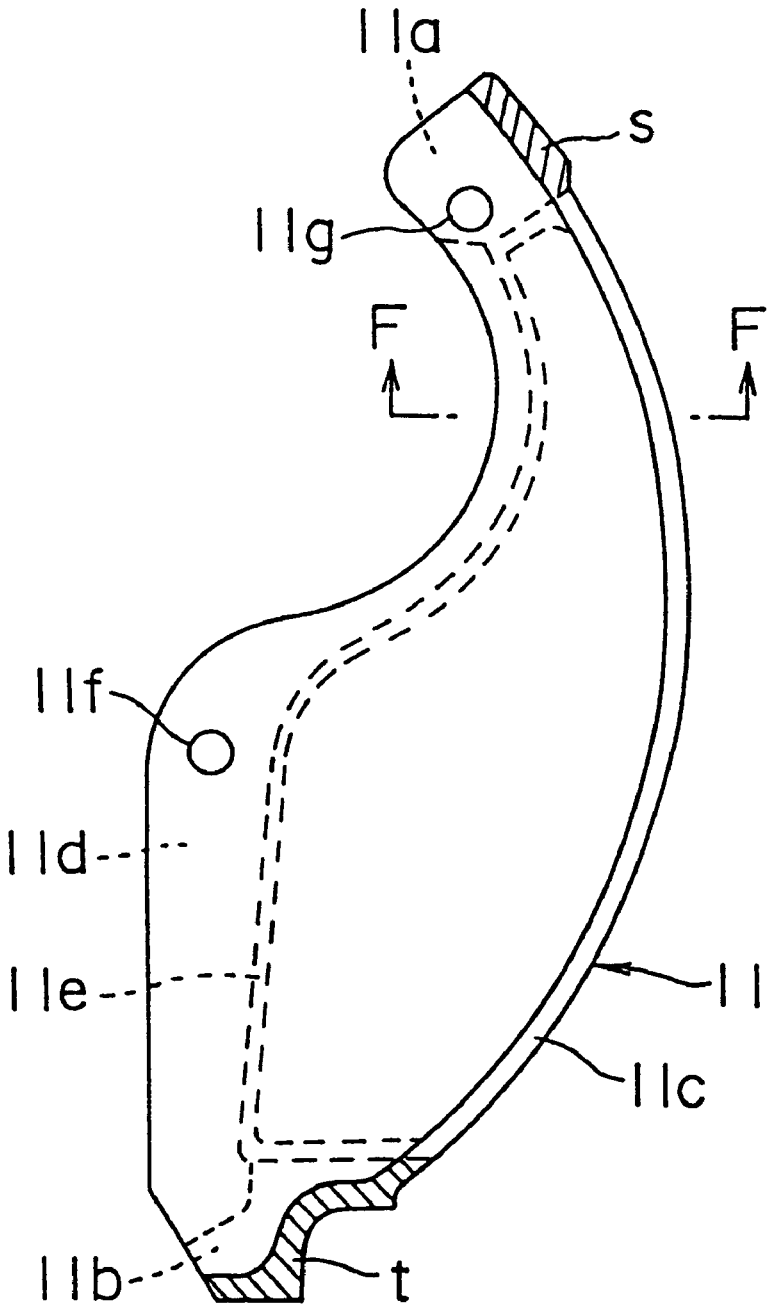
FIG. 5 is a front view of a first air guide member in the aforesaid embodiment.
Figure 6:
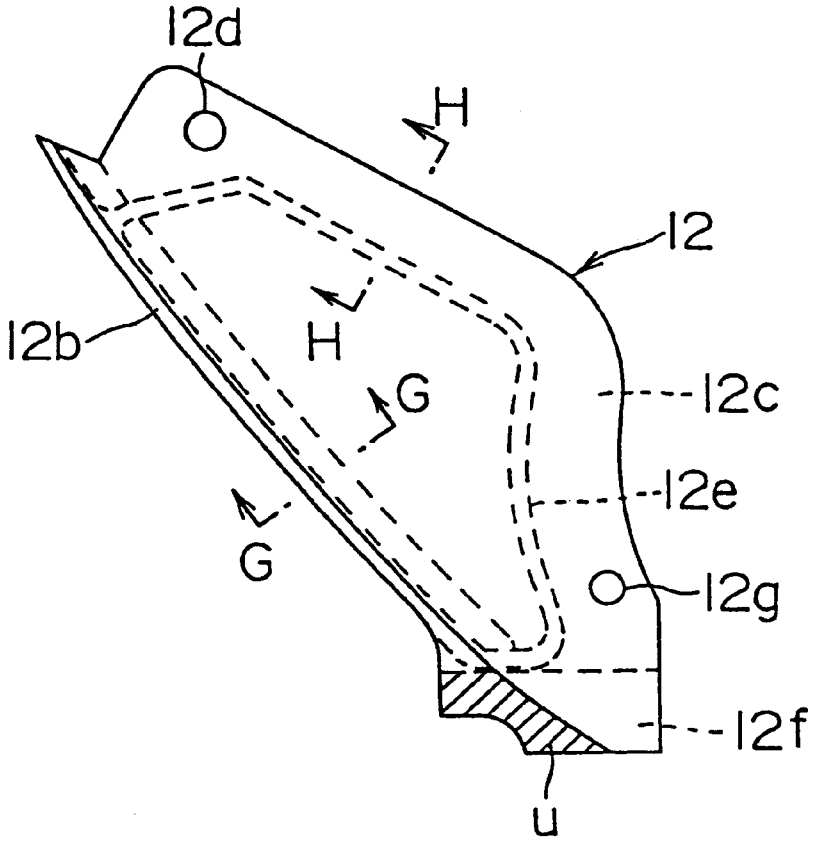
FIG. 6 is a front view of a second air guide member in the aforesaid embodiment.

FIG. 1 is a front view showing a state in which an outside air guide casing for a general-purpose air-cooled single-cylinder engine in accordance with an embodiment of the present invention is removed, FIG. 2 is a front view showing a state in which an outside air guide casing is installed to the engine shown in FIG. 1, FIG. 3 is a sectional view taken along the line A—A of FIG. 1, FIG. 4 is a sectional view taken along the line B—B of FIG. 1, FIG. 5 is a front view of a first air guide member, and FIG. 6 is a front view of a second air guide member.

In FIGS. 1 to 6, reference numeral 1 denotes a forcedly air-cooled type single-cylinder engine (hereinafter simply referred to as an engine), and 2 denotes a cylinder block made of aluminum alloy die casting. The cylinder block 2 is a die-cast product formed integrally by a cylinder barrel having cooling fins 8, a crankcase (not shown), and an inside air guide casing 30, which also constitutes the side of the crankcase. Reference numeral 3 denotes a cylinder head, and 4 denotes a cooling fan rotationally driven by a crankshaft 5.

A first air guide member 11 (see FIG. 5), which consists of a molded product made of synthetic resin, connects the cylinder block 2 to one side (right-hand side in FIG. 1) of an outside air guide casing 6 as shown in FIGS. 1 to 4.

Figure 7:
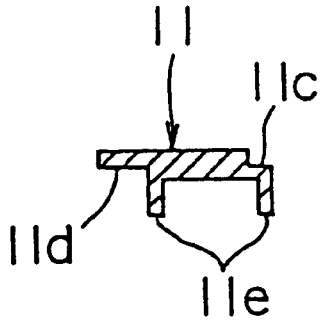
FIG. 7 is a sectional view taken along the line F—F of FIG. 5.

The cross-sectional shape of the first air guide member 11 is as shown in FIG. 7. Specifically, a step 11*d* is provided on the back face on the inner peripheral side, that is, on the side to which the cylinder block 2 is attached, and a step 11*c* is provided on the front face on the outer peripheral side, that is, on the side to which the outside air guide casing 6 is attached. Both of the steps 11*c* and 11*d* form a plane of the same level. In FIG. 7, reference numeral 11*e* denotes a pair of reinforcing ribs formed along the outer edges on the back face of the first air guide member 11 as shown in FIG. 5. The top faces of the paired reinforcing ribs 11*e* form a plane of the same level.

Attaching portions 11*a* and 11*b*, which are attached to the cylinder block 2, at the upper and lower ends of the first air guide member 11 are one step thicker than the body portion as shown in FIGS. 3 and 4. The thickness between the attaching portion 11*a* and the face of the step 11*c* and the thickness between the attaching portion 11*b* and the face of the step 11*c* (the thicknesses of the portions of the attaching portions 11*a* and 11*b* where the step 11*c* is provided) are slightly larger than the depths of air guide member attaching recesses 2*a* and 2*b* of the cylinder block 2, respectively, as shown in FIGS. 3 and 4.

In FIG. 5, reference numerals 11*g* and 11*f* denote pin holes. The positioning of the first air guide member 11 with respect to the cylinder block 2 is accomplished by using positioning pins 13 threadedly inserted into or formed integrally with the cylinder block 2 as shown in FIG. 1.

In FIGS. 1 and 2, reference numeral 12 denotes a second air guide member. This second air guide member 12 is provided at a position substantially symmetrical with the first air guide member 11 with respect to the crankshaft 5.

Figure 8:
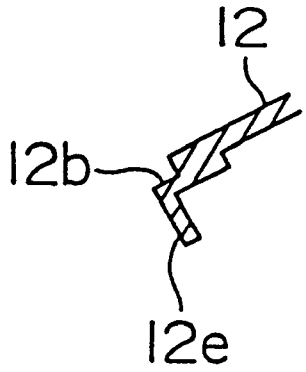
FIG. 8 is a sectional view taken along the line G—G of FIG. 6.
Figure 9:
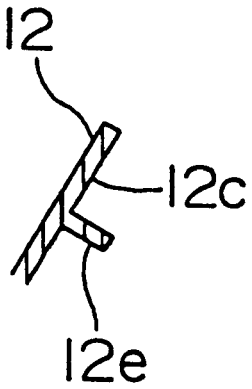
FIG. 9 is a sectional view taken along the line H—H of FIG. 6.
Figure 10:
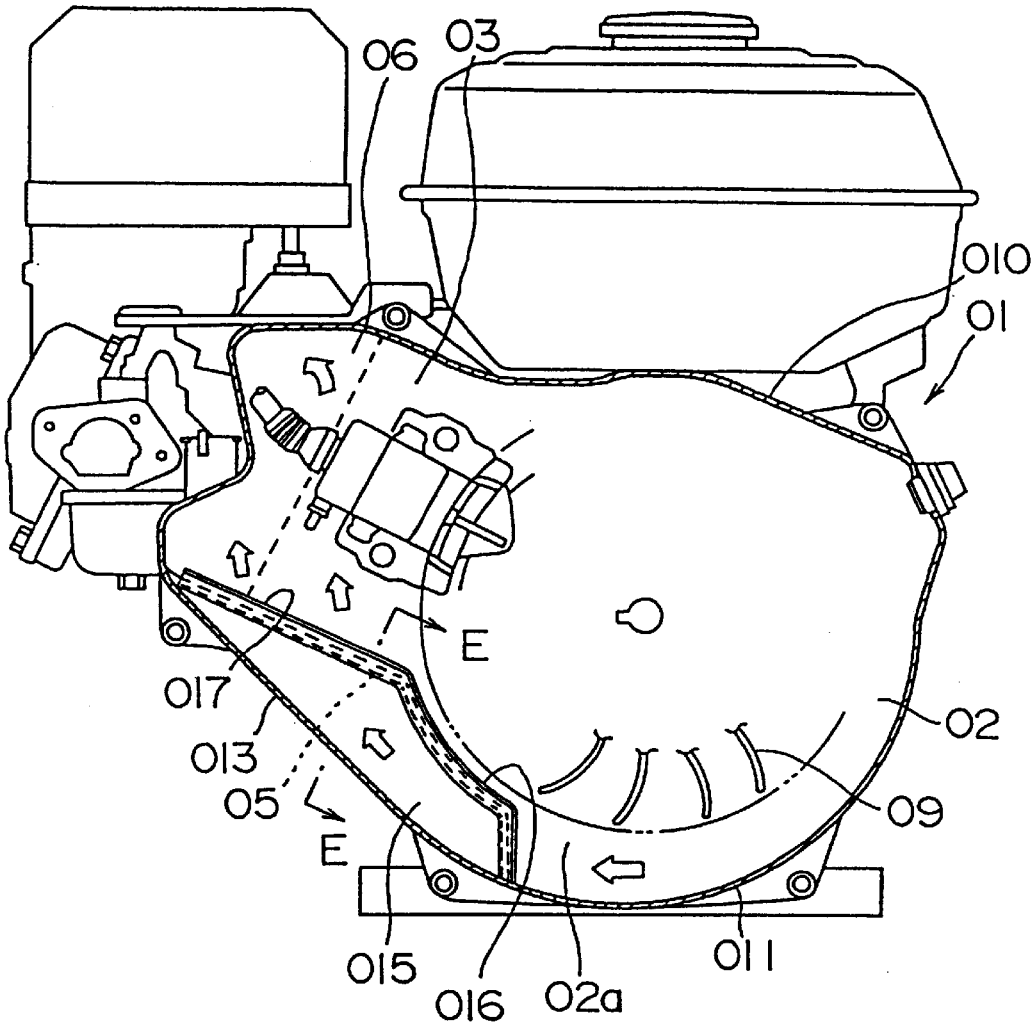
FIG. 10 (PRIOR ART)
FIG. 10 is a front view of a conventional general-purpose air-cooled single-cylinder engine.
Figure 11:
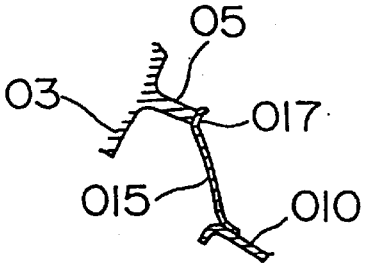
FIG. 11 (PRIOR ART)
FIG. 11 is a sectional view taken along the line E—E of FIG. 10.

The second air guide member 12 consists of a molded product made of synthetic resin like the first air guide member 11, and the cross-sectional shape thereof is as shown in FIGS. 8 and 9. Specifically, a step 12*b* is provided at the outer periphery, and a step 12*c* is provided on the back side at the inner periphery. Both of the steps 12*b* and 12*c* form a plane of the same level.

An attaching portion 12*f* on the lower side of the second air guide member 12 is one step thicker similar to the structure of the first air guide member 11.

The thickness between the face of the step 12*b* and the face of the attaching portion 12*f* is slightly larger than the depth of an air guide member attaching recess 2*c* of the cylinder block 2.

The second air guide member 12 is protrusively provided with a reinforcing rib 12*e* on the back face thereof (on the face on the cylinder block 2 side) as shown in FIGS. 6, 8 and 9. Reference numeral 12*d* denotes a bolt hole for attaching the second air guide member 12 to the cylinder block 2, and 12*g* denotes a pin hole for the positioning pin 13 which positions the second air guide member 12 with respect to the cylinder block 2.

Therefore, the first and second air guide members 11 and 12 are fixed to the cylinder block 2 at the correct position by inserting the positioning pins 13 into the three pin holes 11*f*, 11*g* and 12*g*.

The first and second air guide members 11 and 12 connect with the shape of the inside air guide casing 30 integrally formed on the cylinder block 2 so as to complement a shroud portion of the inside air guide casing 30.

When the outside air guide casing 6 is attached to the cylinder block 2, the first air guide member 11 is positioned by using two positioning pins 13 threadedly inserted into the cylinder block 2, and the second air guide member 12 is positioned by using one positioning pin 13 threadedly inserted into the cylinder block 2. Portions at positions s, t and u indicated by hatching in FIG. 2 are held and pressed between the tightening portions of the outside air guide casing 6 and the cylinder block 2, and fixed to the cylinder block 2 by means of attaching bolts 14 (see FIGS. 3 and 4).

As described above, the thicknesses of the attaching portions 11*a* and 11*b* at both ends of the first air guide member 11 is slightly larger than the depths of the air guide member attaching recesses 2*a* and 2*b* of the cylinder block 2, and the thickness of the attaching portion 12*f* on the lower side of the second air guide member 12 is slightly larger than the depth of the air guide member attaching recess 2*c* of the cylinder block 2. Therefore, when the outside air guide casing 6 is fastened to the cylinder block 2, the attaching portions 11*a* and 11*b* of the first air guide member 11 and the attaching portion 12*f* on the lower side of the second air guide member 12 are pressed surely, by which the air guide members 11 and 12 can be fixed to the cylinder block 2.

As described above, the air guide member attaching recesses 2*a*, 2*b* and 2*c* of the cylinder block 2 are depressed with a step of a dimension such that a press allowance is subtracted from the thickness of the inserted portion of the first and second air guide members 11 and 12, and at the same time, the steps 11*c* and 12*b* at the edges of the first and second air guide members 11 and 12, which come in contact with the outside air guide casing 6, are formed on a plane of the same level as that of the inserted portion, that is, flush with each other. Therefore, when the outside air guide casing 6 is attached, the contact face of the inside air guide casing 30 of the cylinder block 2, that is, the cylinder block 2 and the steps 11*c* and 12*b*, which are the contact faces of the first and second air guide members 11 and 12, are flush with each other, so that the contact faces of the outside air guide casing 6 form a plane of the same level.

Also, the reinforcing ribs 11*e* and 12*e* are provided on the first and second air guide members 11 and 12, respectively, and formed into a gently curved shape between the attaching portions 11*a*, 11*b* and 12*f*. Thereby, after the outside air guide casing 6 and the first and second air guide members 11 and 12 are assembled to the cylinder block 2, a surface pressure can be produced at a portion where the outside air guide casing 6 is connected to the cylinder block 2. This surface pressure can urge the members so as to be in contact with each other without gap.

As described above, since the air guide members consisting of a molded product made of synthetic resin are fixed between the outside air guide casing and the cylinder block, the air guide members connect the outside air guide casing to the cylinder block, so that the air guide members can have a function of complementing the shroud portion of the inside air guide casing. Also, since the air guide members consist of a molded product made of synthetic resin, the weight can be reduced as compared with the conventional shroud made of sheet metal, and a high vibration damping capacity can be achieved, by which the occurrence of noise can be prevented.

Also, since the tightening is performed in such a state that the press allowance is provided by making the thicknesses of the attaching portions of air guide members slightly larger than the depths of the recesses of cylinder block, the air guide members can surely be fixed to the cylinder block.

Thereupon, bolts for fixing the air guide members are unnecessary, so that the number of parts can be decreased, and the assembly man-hour can be reduced.

Further, since the air guide members consisting of a synthetic resin molded product have a higher degree of freedom in shape and higher elasticity than the sheet metal member, by fixing the air guide members between the outside air guide casing and the cylinder block with the press allowance being provided as described above, the gap at the connecting portion can be eliminated completely. Thereby, the leakage of cooling air can be decreased, and the cooling efficiency can be increased.

According to another aspect of the invention, since the reinforcing ribs are provided on the face on the cylinder block side of the air guide members, the presence of the reinforcing ribs can assure a strength sufficient to perform the function of a shroud even if the air guide members consist of a synthetic resin molded product which has a lower strength than the sheet metal member.

INDUSTRIAL APPLICABILITY

As described above, the air guide casing construction for an air-cooled engine in accordance with the present invention is useful as an air guide casing construction for an air-cooled engine having a cylinder block in which a cylinder barrel, crankcase, and inside air guide casing are formed integrally, and suitable for the use in a general-purpose air-cooled single-cylinder engine having a cylinder block made of aluminum alloy die casting.

We claim:

1. An air guide casing for an air-cooled engine having a cylinder block with integrally formed cylinder barrel, crankcase, and inside air guide casing, said air guide casing comprising:

an air guide member comprising a synthetic resin molded product fixed relative to said inside air guide casing and said cylinder block, and having at least one attaching portion;

an outside air guide casing provided on an outer surface of said air guide member so as to cover said air guide member, said outside air guide casing having at least one tightening portion; and positioning means for positioning said air guide member with respect to said cylinder block so that said at least one attaching portion is disposed between said at least one tightening portion and said cylinder block;

wherein said air guide member is fixed by holding and pressing said at least one tightening portion of said outside air guide casing against said at least one attaching portion of said air guide member.

2. An air guide casing for an air-cooled engine according to claim 1, wherein said cylinder block includes a recess dimensioned such that said recess is shallower by a predetermined press allowance than a thickness of the at least one attaching portion of said air guide member.

3. An air guide casing for an air-cooled engine according to claim 1, wherein said air guide member includes a reinforcing rib disposed on an attaching face which is in contact with said cylinder block.

4. An air guide casing for an air-cooled engine according to claim 1, wherein said air guide member is formed so that an edge face which is in contact with said outside air guide casing is coplanar with an attaching face which is in contact with said cylinder block.

5. An air guide casing for an air-cooled engine according to claim 1, wherein said at least one attaching portion of said air guide member is compressed between said air guide casing and said cylinder block with a clamping force sufficient to fixedly secure said air guide member without fixing bolts passing through said air guide member.

6. An air guide casing for an air-cooled engine according to claim 1, wherein said at least one attaching portion of said air guide member is compressed between said air guide casing and said cylinder block with a clamping force sufficient to resist leakage of cooling air.

7. An air guide casing for an air-cooled engine according to claim 1, wherein said at least one attaching portion of said air guide member is compressed between said air guide casing and said cylinder block with a clamping force sufficient to eliminate a gap between said air guide casing and said cylinder block.

8. An air guide casing for an air-cooled engine according to claim 1, wherein a fastener holds and presses said at least one tightening portion against said at least one attaching portion.

9. An air guide casing for an air-cooled engine according to claim 8, wherein said at least one tightening portion comprises a hole, and said fastener comprises a bolt extending through said hole and threadably received in said cylinder block.

* * * * *